US005720182A

United States Patent [19]

Imre

[11] Patent Number: 5,720,182

[45] Date of Patent: Feb. 24, 1998

[54] REFRIGERATION SYSTEM USING COLDAMBIENT SOURCES

[76] Inventor: John J. Imre, 6702 Grant Rd., Vesper, Wis. 54489

[21] Appl. No.: 162,216

[22] Filed: Feb. 21, 1995

[51] Int. Cl.[6] ..... F25B 27/00; F25B 25/00; F25D 23/06

[52] U.S. Cl. ..... 62/236; 62/332; 62/259.1; 62/180; 62/451; 312/408

[58] Field of Search ..... 62/260, 23.81, 62/405, 82, 99, 180, 179, 185, 186, 236, 259.1, 272, 298, 332, 407, 430, 434, 441, 451, 459, DIG. 22; 312/408

[56] References Cited

U.S. PATENT DOCUMENTS

| | | | |
|---|---|---|---|
| 2,400,135 | 5/1946 | Quinn | 62/288 |
| 3,550,677 | 12/1970 | Knowles | 165/1 |
| 4,646,537 | 3/1987 | Crawford | 62/238.6 |
| 4,958,505 | 9/1990 | Swanson | 62/398 |
| 5,282,561 | 2/1994 | Mihalich | 222/146.6 |
| 5,564,284 | 10/1996 | Pugin | 62/126 |

FOREIGN PATENT DOCUMENTS

| | | | |
|---|---|---|---|
| 407305 | 6/1932 | United Kingdom | 62/DIG. 22 |

*Primary Examiner*—William Doerrler

[57] ABSTRACT

The apparatus is composed of a vacuum panel insulated cabinet containing six mirrored cylindrical compartments served by transparent sliding doors and their internal space divided by a rotating disc shelf as well as steel rods positioned through the axis shaft of the disc at right angles. The compartments are cooled with water passing through water jackets that surround them, being pre-chilled by having the water coarse through an ice water bath via a coiled and finned tube in a lidded container. Cold air can also be used directly from outdoors to cool the compartments. A remoted powered cooler is held in reserve. In automatic defrost models the apparatus is integrated with the household hot water plumbing.

4 Claims, 5 Drawing Sheets

Cross Section Of Refrigeration System Using Cold Ambient Sources (Top View)

Cross Section Of Refrigeration System Using Cold Ambient Sources (Top View)

INTERIOR VIEW OF THE CARROUSEL MECHANISM OF AN ECOFRIDGE R/F.

REMOTE PASSIVE WATER PRE-CHILLER

REFRIGERATION SYSTEM USING COLDAMBIENT SOURCES

BACKGROUND OF THE INVENTION

Modem conventional refrigeration systems use a considerable amount of electrical energy. Electrical compressors are notorious energy consumers. The present invention aims to alleviate the refrigerators reliance on electric energy by using naturally occurring cold sources. There also exists a problem of small children becoming trapped in refrigerators. This can have disastrous results as the modem refrigerator is designed to be airtight. Conventional refrigerators also are not convenient and may not even be usable by the elderly and handicapped due to the large volume which may be inaccessible to the user.

SUMMARY OF THE INVENTION

The present invention relates to a refrigerator which is cooled using a variety of ambient cold sources. Cooling may be provided by a combination of domestic cold water, ambient cold air and mechanical cooling. The present invention realizes the great energy savings which can be attained by user performing some of the work. The refrigerator further provides a central support post and horizontal rods to subdivide the cooled volume so that a child can not fit in the cooled volume. The modular refrigerator elements may be stacked either horizontally or vertically to obtain the design which is most attainable and attractive to the homeowner.

It is an object of the present invention to provide a refrigerator which can reduce utility costs by using available ambient cold sources to reduce the reliance on supplied electrical energy. It is a further object of the invention to provide a "Child Savior" feature which prevents children from fitting in the cooled volume.

The invention will now be more fully described with reference to the accompanying drawings, in which.

DESCRIPTION OF THE PREFERRED EMBODIMENT

Figure 1:
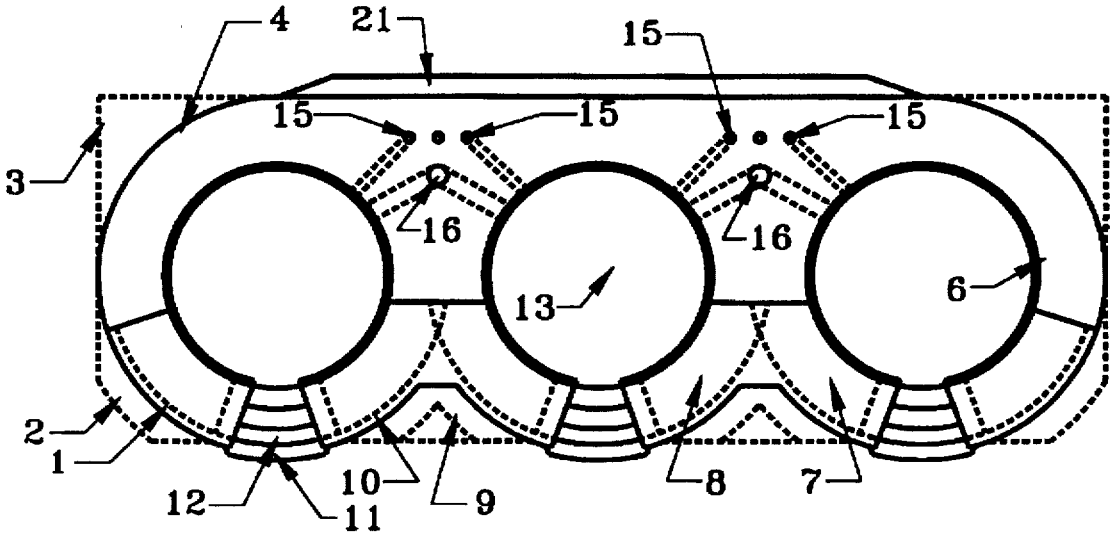
FIG. 1 is a cross section of a top view of the modular refrigeration system of the present invention.
Figure 2:
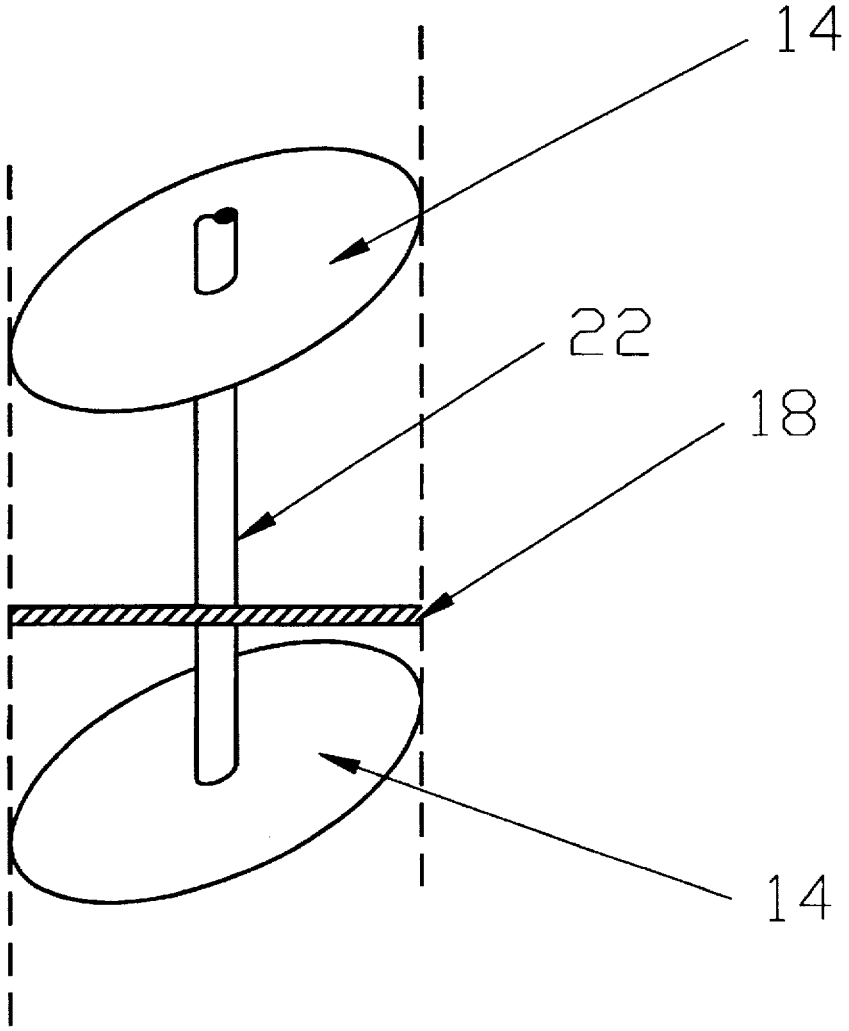
FIG. 2 is an interior view of the carousel mechanism which prevents children from entering the cooled space of the present invention.
Figure 4:
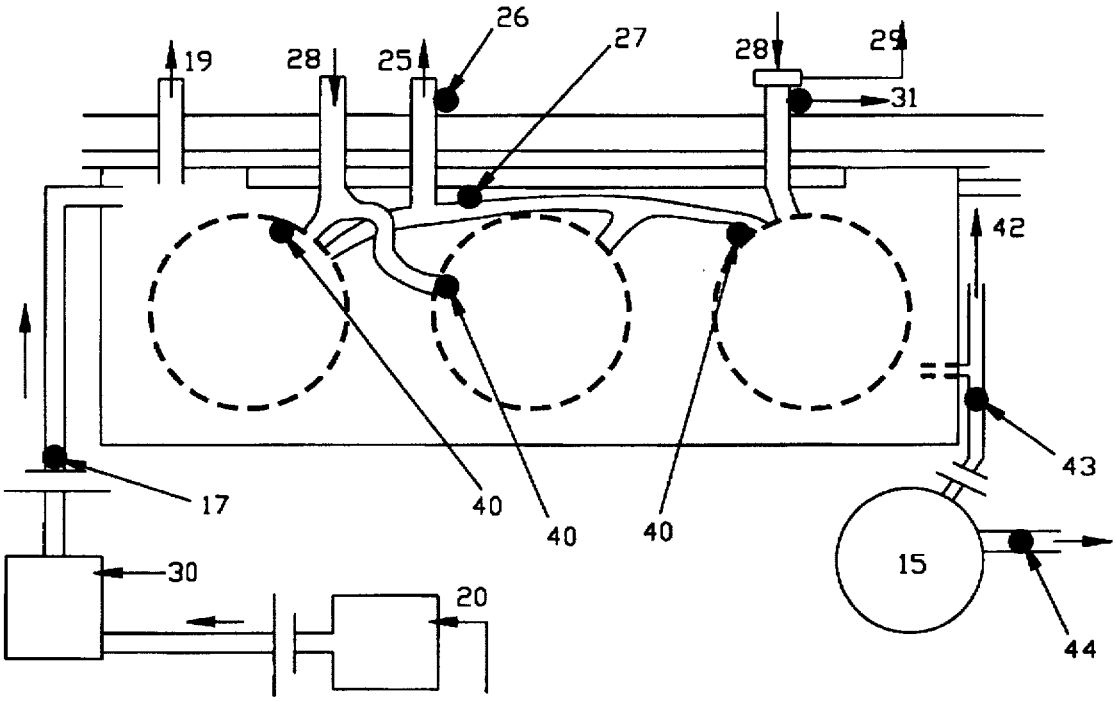
FIG. 4 is a plan schematic view of the present invention.
Figure 5:
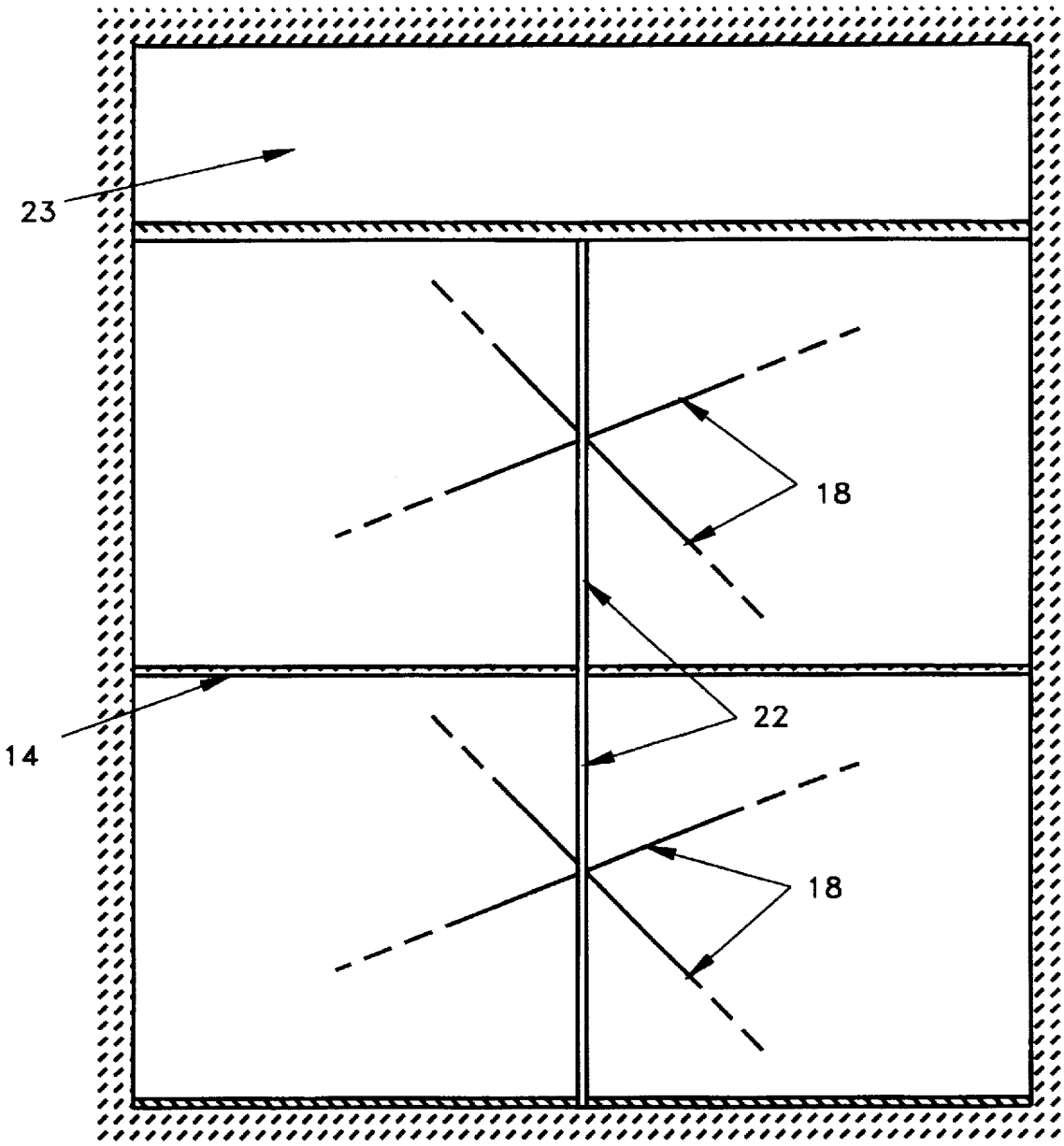
FIG. 5 is a cross section of a front view of the present invention.

The present invention is intended to reduce the amount of man-made energy used to cool food and drinks. This is accomplished by using naturally cooled water and air. The system is augmented if needed by a mechanical cooling system. Thermoaccoustics, which is known and does not by itself constitute part of the present invention, is the preferred method of auxiliary cooling, but any method may be used. As shown in FIG. 1, the volume 13 is cooled by a water jacket 6. A typical cooling cycle begins when rising temperatures are sensed in the refrigerator by a control mean 40. Sensor 27 senses the temperature of the water in the water jacket 6. The control means would actuate an external warning, such as a light emitting diode on the outside of the refrigerator. This would warn the residents of the house to somehow flow cold water, be it by running the kitchen sink, flushing or showering. The use of household cold water would route the incoming cold water from the source 20 through the refrigerator's water jacket 6, through cold water inlets 15 preceded preferably by a precooler 30. The cold water than flows into the water jacket 6, which surrounds the cooled volume and absorb heat therefrom, and then to where the cold water is called for through port 41. This transfer of water occurs every time water is used in the building, whether or not cooling is being on by the refrigerator's sensors. As shown in FIG. 4, a one way check valve 17 is placed in the water admission to prevent the reversal of flow of the cold water. If there is a serious plumbing problem which precludes the flowing of water through the household cold water, including the residents of the house temporarily leaving the house thus not using water, a thermoaccoustic or other electro-mechanical cooling system cools the air in the refrigerator either directly or by cooling the water already in the water jacket.

In parts of the world where the outside air is sufficiently low for at least a portion of the year, outside cold air is admitted into the cooled volume through outside air inlets 16, to provide efficient cooling. If the outside air is not cold enough, the air is further cooled by the electro-mechanical cooling system. A sensor 31 is used to determine the outside temperature and a different sensor 26 determines the temperature of the air exiting the system. The cold outside air is drawn directly into the air duct network through thermosyphoning, the intake port 25 being at a lower elevation than the warm air exhaust port 28. If the outside air is so cold that the contents of the refrigerator would possibly be damaged, the incoming air accepts heat from the room air in the air mix plenum 21. This can be done by either direct air mixing or through the use of a heat exchanger. The air inlet 25 should be provided with a cleanable, reusable air filter to prevent the admission of insects, dirt and dust. A small booster fan 29 can be provided to accelerate the flow of air in the system. Sensors, known in the art, control the functioning of both the air dampers and the fan.

Figure 3:
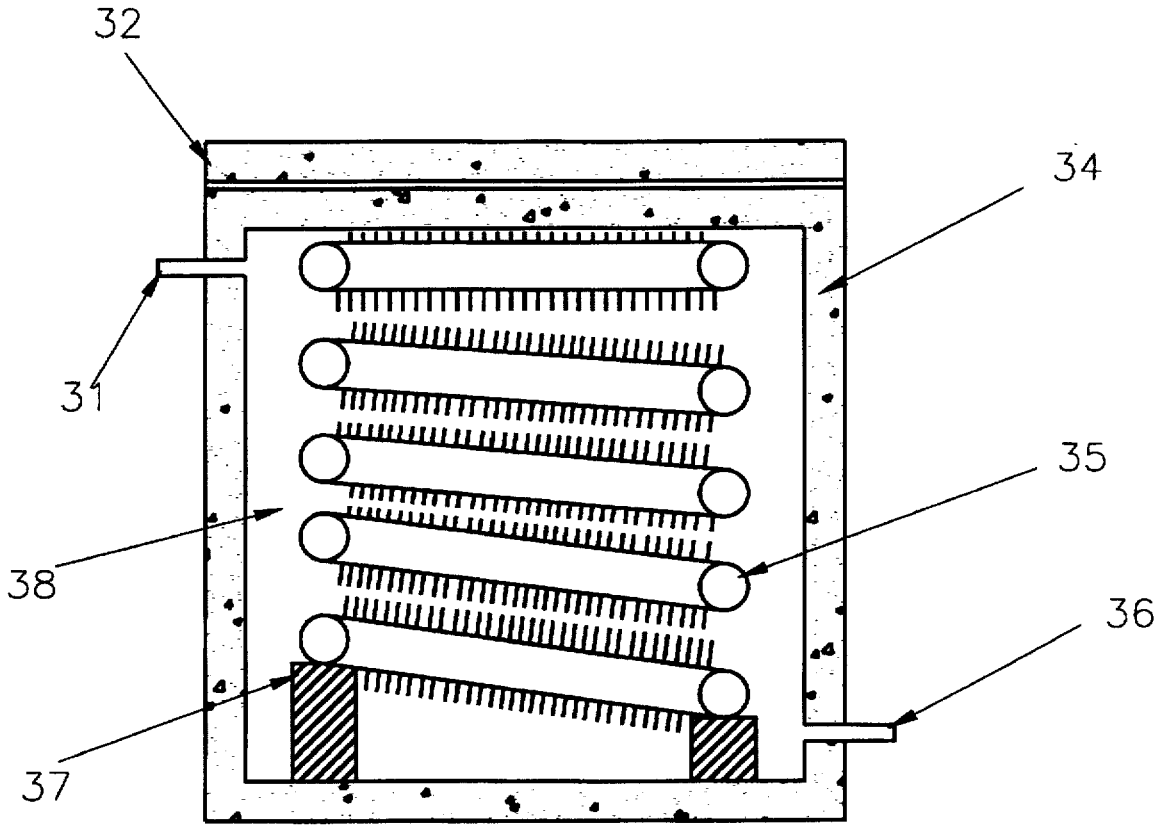
FIG. 3 is a remote passive water pre-chiller.

FIG. 3 shows a remote passive water prechiller 30 which serves to further cool the incoming water. The prechiller 30 consists of an insulated container 34 with an insulated lid 32. The user of the refrigerator fills interior space 38 with ice which may be naturally occurring outdoor ice which will reduce the cost. A finned water coil 35, which is supported off the bottom of insulated container 34 with supports 37, passes through the interior space 38 so that water passing through the coil will be cooled by the ice. When the ice has melted and no longer cools the water it may be drained through drain 36. Port 31 can be used to admit naturally occurring cold water, such as ground water.

If the refrigerator requires defrosting, the air inlet damper can be closed and the refrigerator can be manually defrosted. Alternatively, defrosting can be performed automatically by using an electronic timer to control the inlet of household hot water from the domestic water heater 15 through the water jacket. The hot water can then be either returned to the hot water pipes of the house, or disposed of outside of the house 42. Hot water leaving the hot water heater passes through check valve 44 to prevent reverse flow of hot water. Sensor 43 senses the temperature of water entering the water heater.

The cooled volumes 13 and water jackets 6 are preferably cylindrical. The doors 12 of the refrigerated compartments slide in an arcuate path to either the left or right (to spaces 7 or 8). A layer of insulation 11 may be added to the exterior surface of the sliding door 12. Preferably magnetic seals are used to seal the doors to reduce air loss. Air loss is further reduced by clear polymer strips which hang from the top of the outer circumference of the cooled volume, adjacent the inner surface of the door. The inner volume of the refrigerator is divided by circular shelves 14. The shelves 14 are supported by a central support post 22. The shelves 14 rotate around the central post 22. This permits the contents to be easily viewed using room lighting. The rotating of the shelves can be done manually or optionally mechanically or electrically rotated. The central post 22 also supports horizontal space divider rods 18 at ninety degree angles which further divides the volume so that children will not fit in the refrigerator. The top chamber 23, which is higher than children can reach, does not contain the central post 22 which will permit the storage of large items such as whole pizzas. This chamber 23 is also spaced approximately one fifth of the height of the main chambers 13 to further reduce the chance of a child becoming stuck in the chamber.

The cylindrical outer shell, water jacket and the compartment walls are designed to be made from a polymer material. Insulation 1, preferably vacuum panels, may be added to the circular front of the refrigerator module. Alternatively a thicker, shape changing layer of insulation 2 may be added to the front. Likewise, insulation in the rear of the module may be rounded 4 or square 3 and the spaces between modules may be thinly insulated 10 or thickly insulated 9. The compartments and their water jackets are modular and molded. The individual compartments can be arranged in a horizontal configuration or stacked vertically. The preferred embodiment contains six cylindrical compartments. The carousel shelves 14 are perforated transparent polymer material mounted on a stainless steel axis shaft 22. The divider rods 18 are also preferably made of stainless steel. The door frames 12, which are transparent in the preferred embodiment, and their insulating decorative covers 11 are also made of a polymer. The emphasis on polymer materials is not just due to molding requirements, but also to their meat migration properties. The refrigerator would typically be assembled in the building that the refrigerator will be used. The desired position for the refrigerator is as close as possible to an exterior wall. The electro-mechanical cooling system is sited outside. Then the electric wiring and refrigeration tubing 19 connecting the refrigerated volume and the electro-mechanical system are connected. The prechiller 30 is placed in the basement, under the sink, or some other convenient place and cut into the household cold water plumbing between the source of incoming water and the cabinet. If a vertical configuration is desired, the electro-mechanical cooling system may sit on the top of the refrigerated compartment.

I claim:

1. A refrigeration system comprising a plurality of cylindrical compartments wherein the cylindrical compartments are cooled using household cold water which flows in a water jacket which substantially surrounds an inner cooled volume with the water jacket having a water inlet and a water outlet which are fluidly connected to the household cold water pipes, wherein the air in the inner cooled volume is further cooled when needed by either the direct intake of cold outdoor air when the temperature of outside air is suitably low or a remote electrically powered mechanical cooler, wherein each cylindrical compartment contains a central vertical support rod with a circular shelf attached to the support rod and the support rod further subdivides the cooled volume with pairs of horizontal rods at right angles to each other and the support rod with pairs of horizontal rods spaced both above and below the circular shelf.

2. The refrigeration system as claimed in claim 1, wherein the water jacket further includes a hot water inlet and a hot water outlet fluidly connected to the household hot water pipes to defrost the surfaces of the water jacket when necessary.

3. The refrigeration system as claimed in claim 1, further comprising a prechiller comprised of an insulated container with an insulated lid which define a volume to be filled with ice, with a finned coil passing through the volume with an inlet which attaches to the household cold water pipes and an outlet which is connected to the water jacket of the refrigeration system.

4. The refrigeration system as claimed in claim 1, further comprising sliding doors which are curved, insulated and transparent.

* * * * *